US005211576A

United States Patent [19]

Tonkiss et al.

[11] Patent Number: 5,211,576

[45] Date of Patent: May 18, 1993

[54] STRAIN RELIEF CABLE CLAMP

[75] Inventors: David W. Tonkiss, Glendale; Nestor R. Fuertes, Arleta; Kevin T. Healy, Burbank, all of Calif.

[73] Assignee: Glenair, Inc., Glendale, Calif.

[21] Appl. No.: 766,833

[22] Filed: Sep. 27, 1991

[51] Int. Cl.[5] ..... H01R 13/59

[52] U.S. Cl. ..... 439/462

[58] Field of Search ..... 439/461, 462; 174/75 R; 24/115 M, 136 R, 136 B

[56] References Cited

U.S. PATENT DOCUMENTS

| | | | |
|---|---|---|---|
| 2,331,409 | 11/1942 | Markey | 439/461 |
| 2,882,509 | 6/1954 | Archer et al. | 439/289 |
| 3,430,187 | 2/1969 | De Man et al. | 439/461 |
| 3,621,413 | 11/1971 | Hilbert | 439/462 |
| 3,624,591 | 11/1971 | Buberniak | 439/462 |
| 3,732,527 | 5/1973 | McKnight | 439/320 |
| 4,114,974 | 9/1978 | Lawrence | 439/462 |
| 4,145,075 | 3/1979 | Holzmann | 285/81 |
| 4,208,085 | 6/1980 | Lawrence et al. | 439/462 |
| 4,293,178 | 10/1981 | Lee | 439/462 |
| 4,358,079 | 11/1982 | Navarro | 248/56 |
| 4,854,891 | 8/1989 | Kamei et al. | 439/462 |
| 4,952,174 | 8/1990 | Sucht et al. | 439/584 |

*Primary Examiner*—Gary F. Paumen

*Attorney, Agent, or Firm*—Poms, Smith, Lande & Rose

[57] ABSTRACT

A cable clamp relieves stress between a cable and a connector with which the cable is associated. The cable clamp includes a body defining a passage way through which a cable may pass and having threads. A strain relief clamp is position internal to the body for clamping a cable relative to the body when the cable is passed through the body. A clamp actuator assembly is threaded onto the threads of the body to actuate the strain relief clamp. Serrations are provided for inhibiting unthreading of the clamp actuator element. In an alternative embodiment of the cable clamp, the clamp actuator assembly may include a non-rotating element floating with respect to a clamp nut and engaging the strain relief clamp such that as the clamp nut is threaded onto the body, the clamp clamps the cable more tightly.

43 Claims, 3 Drawing Sheets

STRAIN RELIEF CABLE CLAMP

BACKGROUND OF THE INVENTION

1. Field of the Invention

The present invention relates to strain relief clamps for cables.

2. Related Art

In many applications of electric cables in such environments as aircraft, spacecraft, and the like, the cables are often subjected to flexing and pulling in various directions due to the movement of the craft itself. In applications where cables on one side of a wall are connected to cables on the opposite side of the wall, a connector assembly is used. The connector assembly normally contains a multiplicity of end pins for plugging or inserting into a wall-mounted receptacle to effect an electrical connection. However, because of the stresses on the electrical cable, it is difficult for the connector assembly to maintain a stable connection without a strain relief clamp.

Various types of strain relief clamps are in existence today. Some devices use a cable or wire bundle guide arm such as the wire bundle guide arm described by McKnight in U.S. Pat. No. 3,732,527. Some strain relief clamps such as those called saddle clamp type strain relief clamps use an assembly of screws, nuts and lock washers to accomplish clamping of the cable wherein the assembly of parts are generally exposed. These exposed parts create a potential for damage due to exposed sharp edges to both personnel and equipment, and such elements could be lost during assembly or maintenance, possibly resulting in foreign object damage to the aircraft or other equipment.

In the saddle clamp type of strain relief clamp, the saddles are generally screwed together at their respective ends, resulting in a relatively high stress at the center of each saddle and compound stresses at the threaded screw hole ends. These compound stresses tend to bend the saddles and cause stress fractures and eventually failure of the entire clamp, which may then affect the overall operation of the aircraft or other vehicle. The present invention eliminates the need for such exposed parts.

There is a need for a reliable cable clamp which is more stable than prior cable clamps, and which is self actuating by turning a housing body. There is also a need for a cable clamp having internal clamp means which is protected from external impact and which will not loosen through normal vibration. The present invention provides a cable clamp meeting these needs.

SUMMARY OF THE INVENTION

The new cable clamp according to the present invention provides a more stable and reliable cable clamp having internal and unexposed clamping elements, and one that is easier to use. It also provides a clamp which does not loosen during normal vibrations. In accordance with the present invention, a cable clamp is provided for relieving stress between a cable and a connector with which the cable is associated. A body defines a passageway through which a cable may pass. A strain relief clamp clamps a cable relative to the body when the cable is passed through the body. A clamp actuator threaded to the body actuates the strain relief clamp. Means are provided for inhibiting unthreading of the clamp actuator. With this arrangement, the cable clamp stays clamped even though there are vibrational forces which would otherwise cause the clamp actuator to back off the body.

In another form of the invention, a cable clamp includes a body defining a passageway through which a cable may pass, a strain relief clamp for clamping a cable relative to the body when the cable is passed through the body, and a clamp actuator threaded onto the body. The cable clamp includes a non-rotating element floating with respect to the clamp actuator and engaging the clamp such that as the clamp actuator is threaded onto the body, the clamp clamps the cable more tightly. In this configuration, the cable is reliably and securely clamped in the cable clamp without the need for numerous bolts and nuts to secure the cable quickly and reliably.

In one preferred form of the invention, the strain relief clamp is formed internal to the body and the clamp actuator includes an external sleeve which threads over the body while actuating the internal strain relief clamp. Preferably, the strain relief clamp includes two oppositely disposed saddle bars which are pressed toward each other by the clamp actuator as the sleeve is threaded onto the outside of the body.

In a further form of the invention, the strain relief clamp is formed from a pair of oppositely disposed saddle bars with an actuation ramp centrally located on the outside of each saddle bar to complement ramp portions on a wedge ramp whose position relative to the saddle bar ramps is controlled by the threading of the clamp actuator.

It is therefore an object of the present invention to provide a cable strain relief clamp which provides a secure and reliable clamp for association with a cable connector.

It is a further object of the present invention to provide a strain relief cable clamp where the cable is clamped internally to a body so that the clamping is shielded and protected from outside impact.

It is another object of the present invention to provide a strain relief cable clamp which remains securely clamped even in spite of constant vibrational forces.

It is still a further object of the present invention to provide a strain relief cable clamp which does not require tools for assembly and which can actuate clamping of the cable simply by rotating a sleeve threaded onto the clamp body enclosing the cable clamps.

It is an additional object of the present invention to provide a strain relief cable clamp which is easily assembled and installed by technical and maintenance personnel with a minimum of training necessary.

It is a further object of the present invention to provide a cable strain relief clamp which avoids the requirement of miscellaneous screws, nuts, lock washers or other exposed clamping components. A subsidiary benefit is avoidance of possible loss of small parts on assembly or during use which could also result in foreign object damage to aircraft or other equipment. The present invention also avoids sharp, exposed edges and avoids the requirement of the use of possibly damaging tools such as screw drivers, pliers and wrenches.

It is a still further object of the present invention to provide a cable strain relief clamp wherein the clamp prevents axial and rotational movement of the cable.

It is also an object of the present invention to provide a cable clamp which is self-locking.

These and various other objects and advantages of the inventive strain relief clamp will become apparent to those skilled in the art from a consideration of the following detailed description of the preferred embodiments and appended drawings which will first be briefly described.

DETAILED DESCRIPTION OF THE PREFERRED EMBODIMENTS

In accordance with the present invention, a strain relief cable clamp is disclosed which provides for a more stable and reliable strain relief assembly for attachments to a cable connector. The strain relief cable clamp of the present invention is easier to use than prior cable clamps and, in the preferred embodiment, clamps the cable completely internal to the body of the cable clamp. Exposed parts and possible loss of individual screws and bolts is minimized with the present invention.

Figure 1:
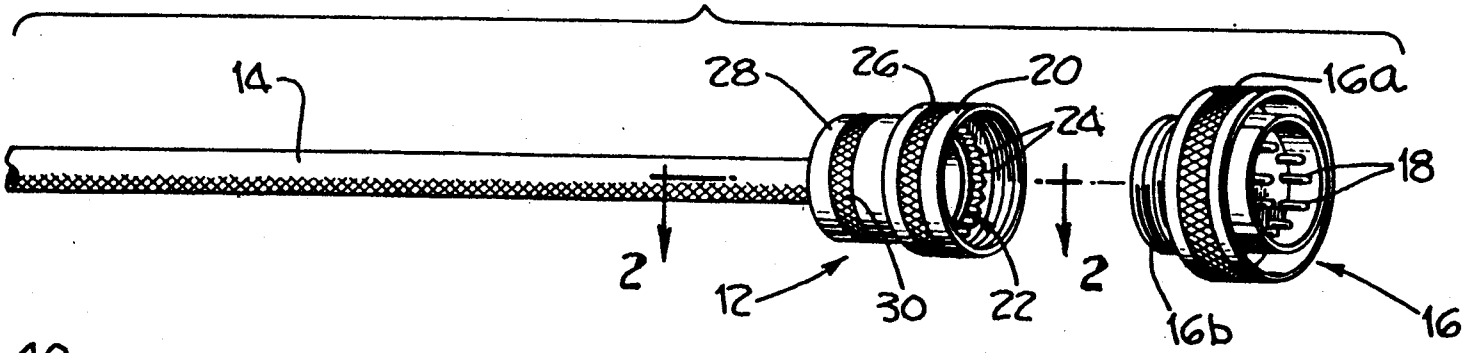
FIG. 1 is an exploded view of an exemplary embodiment of a strain relief cable clamp, according to the present invention, associated with a conventional multiple pin end plug.

Referring now to FIG. 1, a strain relief clamp 12 is shown for clamping a cable 14 to relieve any stress, strain or pull by the cable on a connector 16 or its corresponding pins 18 when the clamp is associated with the connector. The connector 16 includes a coupling nut 16*a* and a connector accessory thread 16*b* as is well known in the art. The strain relief clamp may be of any design on the front end to accommodate the variety of needs for the connector industry. In a particular embodiment shown in FIG. 1, the strain relief clamp 12 includes a rotatable threaded coupling nut 20 so that the clamp can be threaded onto the connector accessory thread 16*b*. An anti-rotation device 22 may be incorporated within the nut 20 to prevent rotation relative to the connector 16. In the configuration of the anti-rotation device 22 shown in the drawings, a series of teeth 24 are formed interior to the coupling nut 20 facing in an axial direction to engage corresponding teeth in the connector 16. The strain relief clamp also preferably includes a self-locking device (not shown) to keep the coupling nut 20 from backing off of the connector 16 due to vibration or other forces. The self-locking device may include one or more detent leaf springs coupled for rotation with the coupling nut. The detent spring includes at least one protrusion for engaging radially extending circumferential teeth next to the teeth 24 so that the coupling nut is releasably locked relative to the rest of the clamp. The coupling unit 20 preferably includes external knurling or other appropriate gripping surface 26 to facilitate threading and unthreading of the coupling nut with the connector 16. A rotatable clamp nut 28 on the strain relief clamp 20 also includes external knurling or other appropriate gripping surface 30 to facilitate threading and unthreading of the clamp nut 28.

Figure 2:
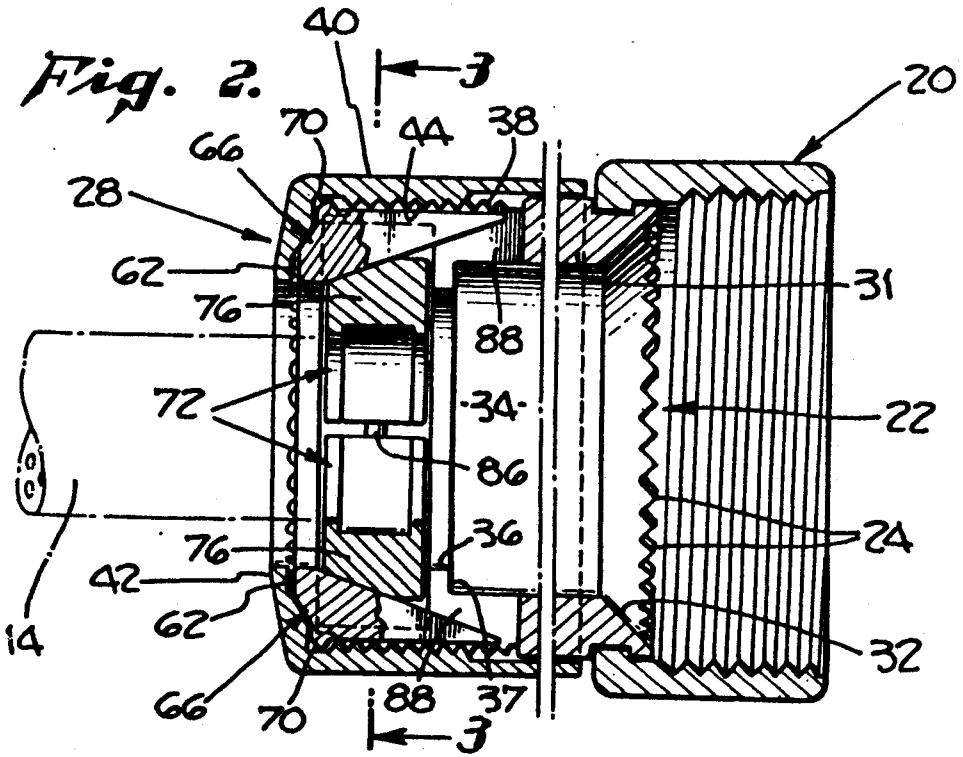
FIG. 2 is a transverse sectional view of a preferred embodiment of the clamp according to the present invention taken along the line 2—2 of FIG. 1.
Figure 5:
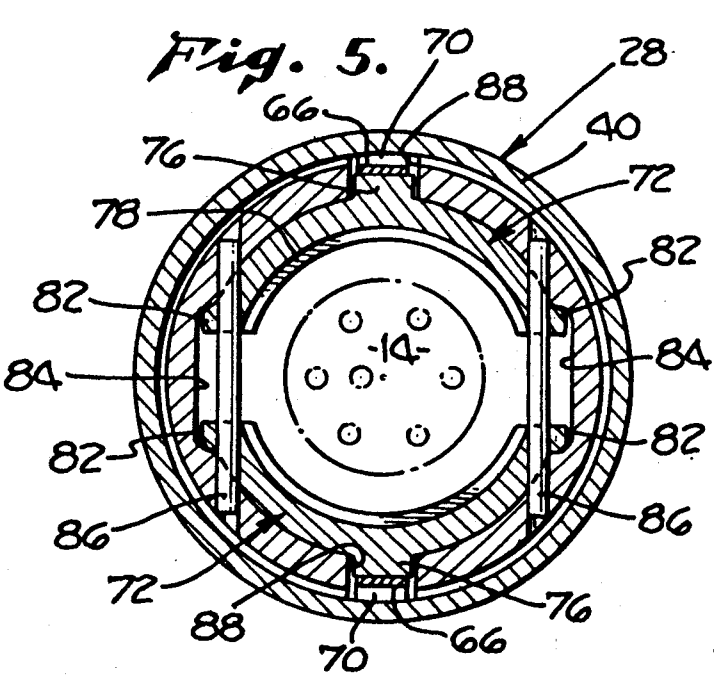
FIG. 5 is a transverse sectional view similar to that of FIG. 3 with the cable being shown in an un-clamped configuration.
Figure 7:
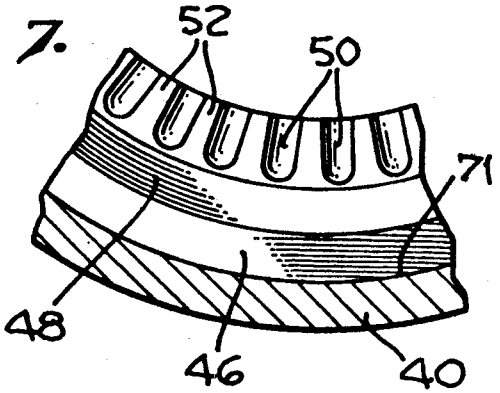
FIG. 7 is an enlarged fragmentary view taken along the line 7—7 of FIG. 6 of a portion of a clamp nut.

Considering the strain relief clamp 12 in more detail in conjunction with FIG. 2, the clamp includes a body 31 in which is formed a countersink surface 32, formed rearward of the teeth 22, opening into a bore 34. A counter bore 36 is formed rearward of the bore 34 to form a separator wall 37 between the forward portion of the clamp body 31 and a rear portion of the clamp body, to be described more fully below.

In the preferred embodiment, the rear portion of the clamp body 31 includes external threads 38 formed on the outside thereof, for accepting the clamp nut 28 through threaded engagement. The clamp nut 28 is threaded onto the body by turning the clamp nut through the knurling 30 on the outer wall 40 of the clamp nut. As shown most clearly in FIG. 9, the interior of the wall 40 includes internal threads 44 for a threaded engagement with the corresponding external threads on the clamp body 31. Threading and unthreading of the clamp nut 28 tightens and loosens the clamp about the cable 14. The internal threads terminate near the rearmost portions of the clamp nut at a groove and before a transversely extending shoulder 46 (FIG. 6) extending radially inward from the internal wall of the clamp nut 28. The shoulder 46 extends inwardly to a bevelled bearing surface 48 extending inwardly and rearwardly from the shoulder 46 to a series of radially inwardly extending grooves 50 and ridges 52 or serrations for providing recesses to prevent the clamp nut 28 from backing off the clamp body as a result of vibrational or other forces. The grooves and ridges terminate at an opening 54 on the rear face 42 of the clamp nut.

Figure 6:
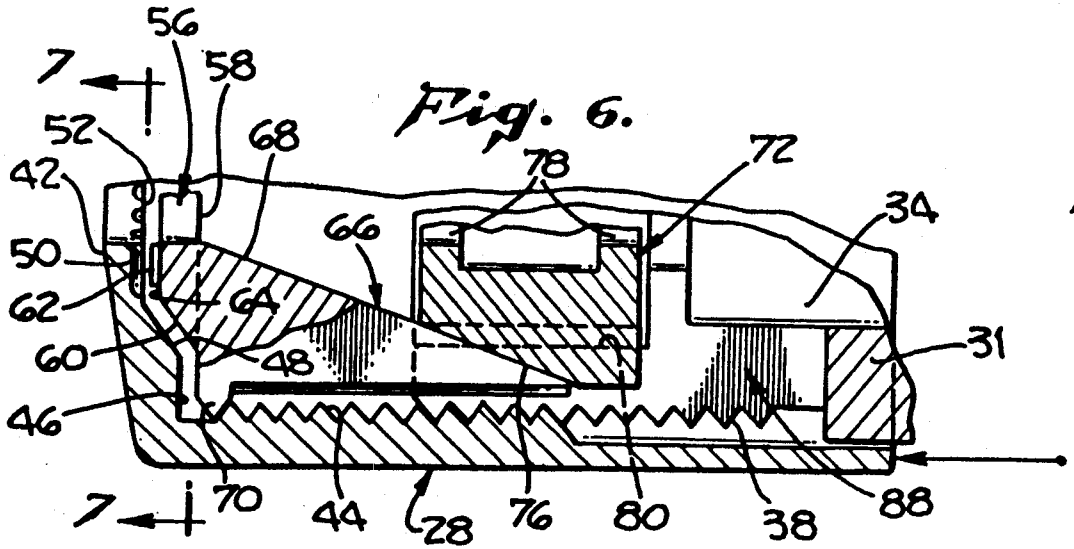
FIG. 6 is an enlarged fragmentary view of a portion of the clamp shown in FIG. 2 showing a locking feature in an unlocked position in accordance with a preferred embodiment of the present invention.
Figures 8, 9, 10:
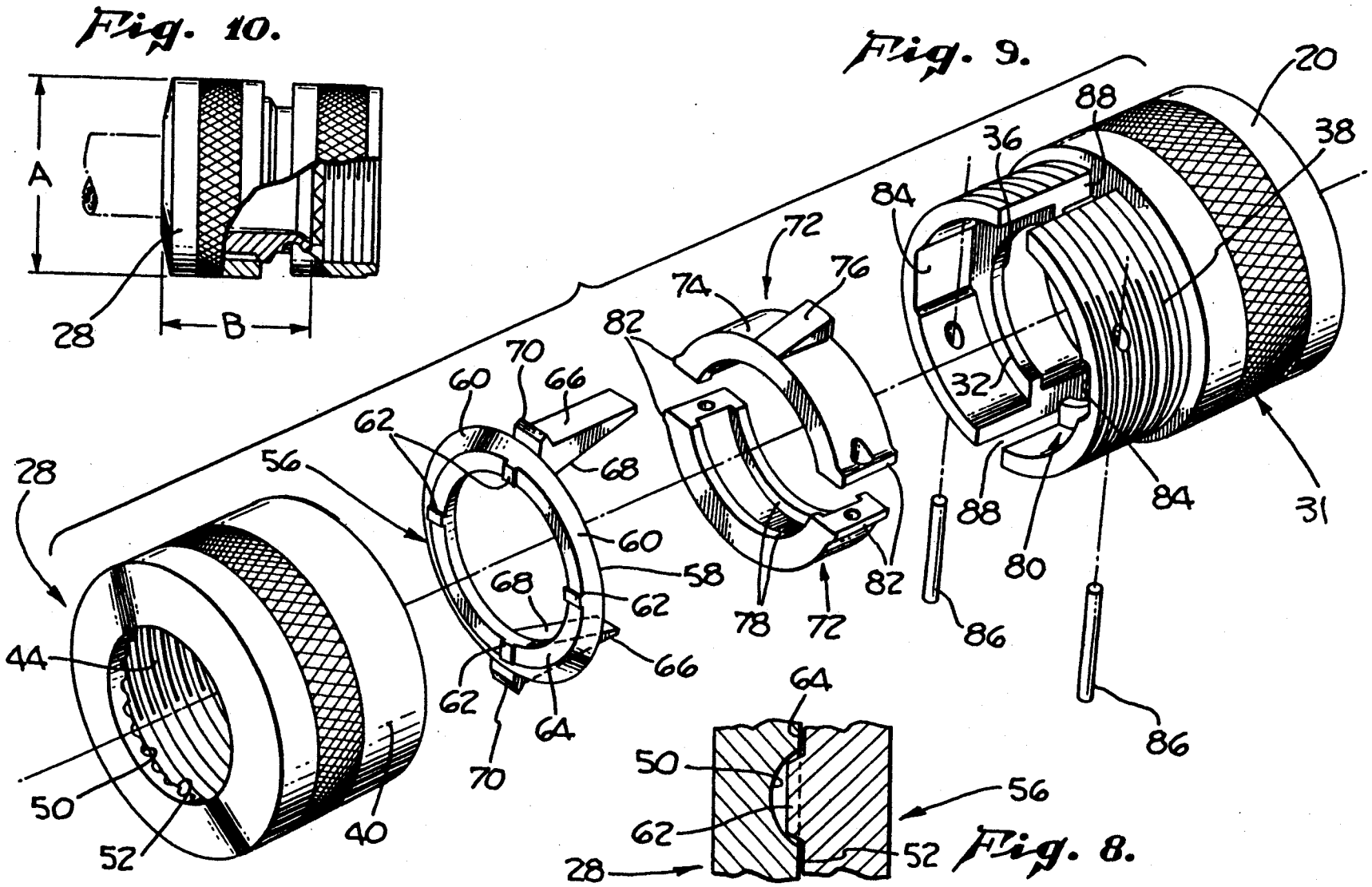
FIG. 8 is an enlarged fragmentary view of a detent on a wedge ring engaging a detent grove on the clamp nut taken along the line 8—8 of FIG. 4.
FIG. 9 is an exploded view of the strain relief clamp shown disassembled in accordance with a preferred embodiment of the present invention.
FIG. 10 is a side and partial cut-away view of a clamp according to the present invention.

In the preferred embodiment, the clamp nut 28 combines with a wedge ramp ring 56 to form an assembly such that the clamp nut 28 actuates clamping of the cable 14 through the wedge ramp ring 56 (FIGS. 6 and 9). The wedge ramp ring 56 has a forward flat ring face 58 and a rearward facing beveled surface 60. The beveled surface 60 is contacted by the beveled surface 48 on the inside of the clamp nut 28 when the cable 14 is fully clamped.

The wedge ramp ring 56 includes preferably four uniformly distributed, rearwardly facing detents 62 raised from the rearwardly facing flat surface 64 of the ring for holding the clamp nut 28 in place against vibrational forces once tightened down. The detents 62 engage the ridges 52 in the clamp ring and slide over the ridges until the cable is almost fully clamped, at which time continued rotation of the clamp nut 28 will lock one or more of the detents 62 in respective grooves 50 as the clamp ring is threaded onto the clamp body 24 a sufficient amount to fully clamp the cable 14. FIG. 8 shows one detent 62 resting in a corresponding groove 50. Locking of the detents in corresponding grooves 50 keeps the clamp nut from backing off the clamp body 24 as a result of vibrational or other similar forces but still allows release by manually unthreading of clamp nut 28.

The ring includes two, preferably, wedge ramps mounted on the ring at diametrically opposed locations on the ring 56 for causing clamping of the cable as the clamp nut 28 is threaded onto the clamp body 31. Each wedge ramp preferably includes a forwardly and outwardly sloping ramp surface to engage correspondingly sloped surfaces inside the clamp body for clamping the cable. Each wedge ramp 66 includes an outwardly extending ridge 70 on the outer, rearward portion of each wedge ramp (FIGS. 6 and 9). Each ridge 70 is preferably slightly curved to have a curvature sufficient to be threaded along the internal threads 44 of the clamp nut 28 so that the wedge ramp ring 56 can be threaded into the inside of the clamp nut and into a circumferential groove 71 (FIG. 6) at the base of the clamp nut, between internal threads 44 and shoulder 46, to allow the wedge ramp ring to float in the clamp nut as the clamp nut is being threaded onto the clamp body 31. As a result, the wedge ramp ring 56 preferably does not rotate with the rotation of the clamp nut 28.

Figure 3:
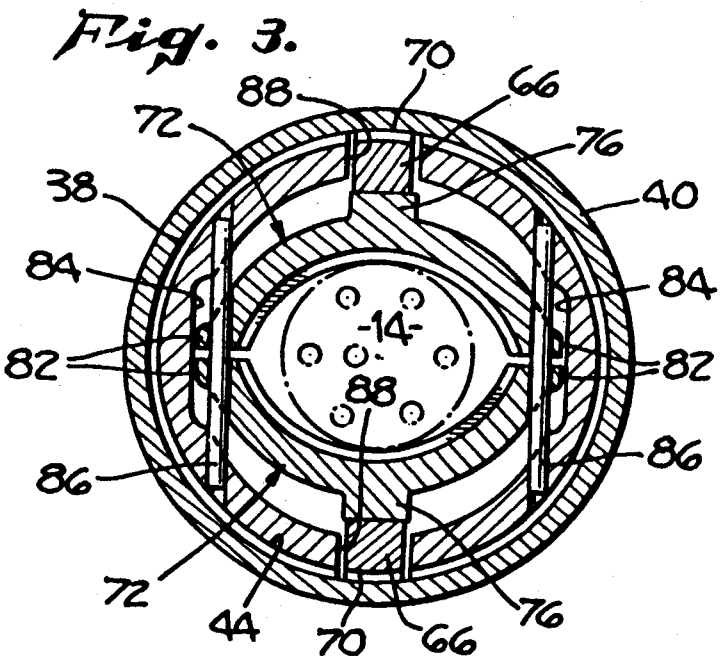
FIG. 3 is a transverse sectional view taken along the line 3—3 of FIG. 2 with a cable being shown in a clamped position in accordance with a preferred exemplary embodiment of the invention.

The cable 14 is clamped relative to the clamp body 24 preferably by means of two saddle bars 72 axially stationary relative to the body 71 so that pulling forces and stresses and strains developed in the cable do not affect either the connection made through the connector 16 (FIG. 1) or the connections made between the individual wires and the multiple pins 18 in the connector. Each saddle bar 72 is formed from a truncated half circle with an outer arcuate surface 74 and a rearwardly sloping wedge 76 with which a corresponding wedge ramp 66 interacts to force the saddle bar inwardly against the cable as the clamp nut is threaded onto the clamp body 31. The ramp slopes rearwardly and inwardly from the outer circumferential surface of the saddle bar to compliment the ramp surface 68 on the wedge ramp 66. Preferably, the second saddle bar 72 also includes a corresponding ramp 76, as shown in FIGS. 2 and 3. The inside, cable-contacting surface of each saddle bar includes front and back, cable gripping, arcuate ridges 78 extending substantially about the entire inside arcuate surface of each saddle bar 72.

The saddle bars 72 are inserted in and retained by a rearward opening bore 80 (FIG. 9) separated from the first and second bores 34 and 36, respectively, by the separator wall 32. The arcuate end of each saddle bar includes longitudinally and radially outwardly extending bosses 82 (FIG. 3) captured in and guided by oppositely disposed grooves 84 formed in the sides of the bore 80. The saddle bars are axially retained in the bore 80 of the clamp body 31 by a pair of roll pins 86 passing through respective holes in the walls of the bore 80 and in the ends of the saddle bars 72. The roll pins 86 and the holes in the saddle bars are sized such that the saddle bars can slide along the roll pins 86 as the clamp nut is threaded onto and off of the clamp body 31. The grooves 84 allow the saddle bar to move along the pins 86. Each ramp 76 slides radially into and out of respective grooves 88 formed diametrically opposed to each other in the walls of the rear bore 80, the separator wall 37 and part of the first bore 34. Each groove is formed in the wall of the clamp body 24 preferably 90 degrees from the adjacent grooves 84. The slots 88 also captivate and guide the wedge ramps 66 of the wedge ramp ring 56 to keep the ring from rotating with the clamp nut 28, and also to guide each wedge ramp 66 over the respective saddle bar ramps 76 to push the saddle bars together, thereby clamping the cable as the clamp nut 28 is threaded onto the clamp body 31. Captivation of the wedge ramps 66 allows the ring to float in the clamp nut 28 as the clamp nut is rotated. The wall 40 of the clamp nut 28 preferably extends forwardly to a skirt 89 (FIG. 2) sufficiently long to cover the slots 88 whenever the clamp nut is threadably engaged with the body.

With this preferred combination, the clamp nut 28 and its captivated wedge ramp ring 56 actuate the internal saddle bars 72 when the clamp nut 28 is threaded onto the external threads 38 of the clamp body 31. The clamp nut and wedge ramp ring actuate the saddle bars to push the saddle bars toward each other as the clamp ring is threaded onto the clamp body and the wedge ramps 66 engage and ride over the complimentary ramps 76 on the saddle bars. Because the wedge ramp ring 56 floats within the clamp nut 28, rotational threading movement of the clamp nut translates into axial movement of the wedge ramp ring 56, which then forces the saddle bars 72 toward each other. Since the wedge ramp ring 56 and the saddle bars 72 are internal to the combined housing formed by the clamp nut 28 and the body 24, these elements are not exposed to impact or interference from outside elements, and no tools are required for actuation of the clamping saddle bars. Additionally, because the saddle bars are movably retained on the roll pins 86 and because the wedge ramps ring 56 is slidingly retained in the clamp nut 28, any possibility that parts can be lost during assembly or maintenance is minimized. Because the ramps 76 are located midway between the respective ends of each saddle bar, the clamping force is applied to the center of the saddle bars rather than at each end so that the loads on the saddle bars are distributed equally from the center towards each end, thereby reducing the net stress by approximately one half, relative to the stress created in prior saddle bar clamps brought together by nuts and bolts passing through the ends of the saddle bars.

In operation, the clamp nut 28 and the wedge ramp ring 56 is passed over the end of a cable and the clamp body, including the saddle bars retained by the roll pins 86, are then placed over the cable end. The coupling nut 20 is threaded onto the end plug accessory threads engaging the corresponding interfacial teeth. The clamp nut 28 and the ring 56 are then engaged with the rear portion of the clamp body 31 by threading the clamp nut 28 on the external threads on the clamp body while the ring rotates until the wedge ramps 66 engage the slots 88 in the clamp body. The saddle bars will typically be biased outward by the flexibility and resilience of the cable.

Figure 4:
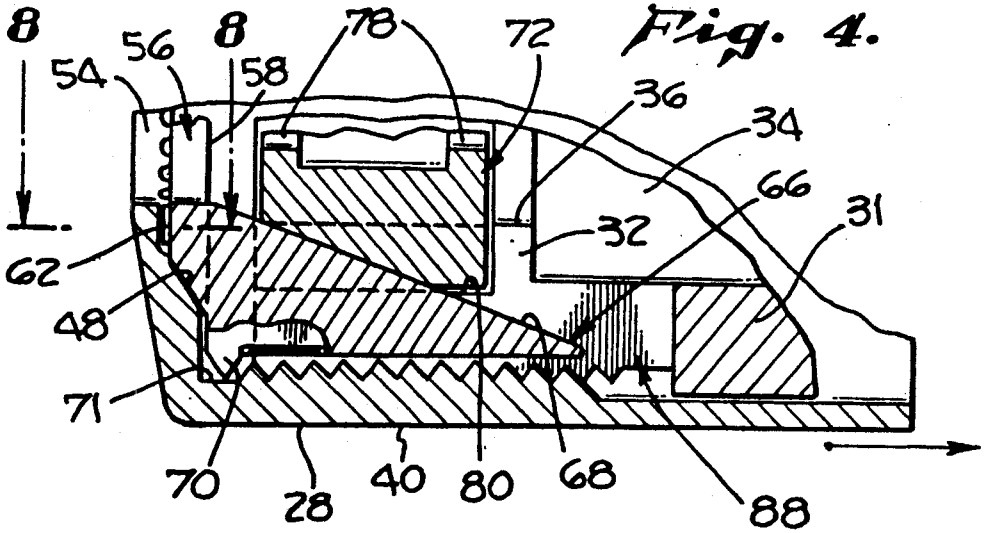
FIG. 4 is an enlarged fragmentary view of a portion of the clamp shown in FIG. 2 showing a locking feature of the clamp in a preferred exemplary embodiment of the present invention.

As the clamp nut is threaded onto the clamp body, the wedge ramps 66 eventually engage the ramps 76 on the saddle bars to form the configuration shown in part in FIG. 6. In this configuration, the clamp nut is partially threaded onto the clamp body, the wedge ramps 66 engage the complimentarily sloped surfaces on the respective ramps 76, and the ridges 70 are captivated in the groove 71 of the clamp nut. The detents 62 on the ring 56 generally do not engage the serrations or ridges 52 on the clamp nut at this point, or only slidingly engage those ridges. As the clamp nut 28 is threaded further onto the clamp body 31, the wedge ramps 66 slide toward and over the corresponding ramp 76 while being guided and captivated by the slots 88 in the wall of the clamp body 24. As the saddle bars engage the cable, an opposite force is developed in the cable against the inward movement of the saddle bars, and therefore against the continued forward movement of the wedge ramps 68, thereby pushing the ring 56 rearward against the forward motion of the clamp nut. As the clamp nut rotates the detents 52 on the serrations and ride over the ridges. As the clamp nut threads further on the clamp body, the opposing force on the saddle bars developed by the resilience in cable material pushes the ring harder against the ridges until such time as the detents fully engage respective grooves 50 in the serration and the clamp nut cannot be rotated further. Complete engagement of the clamp nut with clamp body and engagement of the detents 62 with a corresponding groove 50 can be seen in FIG. 4. In the configuration of FIG. 4, the ramps 72 have ridden up a significant distance on the wedge ramps surfaces 68 to clamp the cable. As shown in FIG. 3, the saddle bars in the clamped configuration such as shown in FIG. 4 have moved along the roll pins 86 and away from the respective sides of the clamp body 24.

The strain relief clamp may be formed from suitable material such as nickel or anodized aluminum or other materials meeting appropriate specifications.

Tables I and II show various dimensions which could be used for the cable clamp with reference to FIG. 10, wherein dimension "A" corresponds to the outside diameter of the clamp nut 28 and the dimension "B" refers to the distance between the rear most portion of the clamp nut 28 to the rear surface of the first bore 30. Table II shows the minimum and maximum diameters of the cables which can be accepted by the corresponding shell sizes given in Table I.

The resiliency of the cable acts as a spring such that the frictional movement of the wedge ramps onto the saddle bar ramps produces pressure against the inner surface of the ring 56 at the respective terminating locations of the wedge ramps. The ring 56 pushes onto the shoulder 46 and grooves 50 and ridges 52 of the narrowed end portion of the clamp nut causing the detents to matingly engage the serrations, producing in effect a ratchet which prevents undesirable rotation, i.e. loosening, of the clamp about cable. The front end design of the body 20 may be of any convenient configuration to accommodate various accessory interface configurations or as a complementary component of a more complicated backshell assembly.

TABLE I

| Shell Size Number | MAX Cable Entry Desig. | A (in.) | B (in.) MIN | B (in.) MAX |
|---|---|---|---|---|
| 8 | E1 | 0.690 | 1.15 | 1.380 |
| 10 | E2 | 0.880 | 1.36 | 1.620 |
| 12 | E3 | 1.010 | 1.36 | 1.620 |
| 14 | E4 | 1.190 | 1.36 | 1.620 |
| 16 | E5 | 1.320 | 1.28 | 1.620 |
| 18 | E6 | 1.440 | 1.28 | 1.620 |
| 20 | E7 | 1.690 | 1.27 | 1.610 |
| 22 | E8 | 1.620 | 1.28 | 1.670 |
| 24 | E9 | 1.940 | 1.27 | 1.650 |

TABLE II

| MAX Cable Entry Desig. | Cable Entry MIN | Cable Entry MAX |
|---|---|---|
| E1 | 0.098 | 0.250 |
| E2 | 0.203 | 0.375 |
| E3 | 0.328 | 0.500 |
| E4 | 0.452 | 0.625 |

TABLE II-continued

| MAX Cable Entry Desig. | Cable Entry MIN | Cable Entry MAX |
|---|---|---|
| E5 | 0.515 | 0.750 |
| E6 | 0.640 | 0.875 |
| E7 | 0.765 | 1.000 |
| E8 | 0.859 | 1.125 |
| E9 | 0.984 | 1.250 |

We claim:

1. A cable clamp for relieving stress between a cable and a connector with which the cable is associated, the cable clamp comprising:

a body defining a passageway through which a cable may pass;

a strain relief clamp with a cable contact portion at least partly internal to the body for clamping a cable relative to the body when the cable is passed through the body and wherein the clamp is formed from at least one relatively non-resilient clamp element;

a clamp actuator assembly engaging the body to actuate the strain relief clamp; and means for inhibiting disengagement of the clamp actuator assembly from the body;

wherein the clamp actuator assembly includes a clamp nut threaded onto the body and a non-uniform surface on the clamp nut, and wherein the inhibiting means includes means for engaging the non-uniform surface on the clamp nut, which engaging means is substantially rotationally fixed relative to the body; and wherein the body includes at least one grooves extending axially of the body and the engaging means includes a detent formed on a ring wherein the ring has an axially extending element for engaging the grooves in the body whereby the detent is prevented from rotating with respect to the body.

2. The cable clamp of claim 1 wherein the non-uniform surface include serrations on an internal surface of the clamp nut.

3. The cable clamp of claim 2 wherein the engaging means comprises at least one detent to engage the serrations on the clamp nut.

4. The cable clamp of claim 1 wherein the ring engages the clamp nut and floats with the clamp nut when the clamp nut threads on the body but remains rotationally fixed relative to the body as the clamp nut is threaded on the body.

5. A cable clamp for relieving stress between a cable and a connector with which the cable is associated, the cable clamp comprising:

a body defining a passageway through which a cable may pass and including an engagement surface;

a strain relief clamp internal to the body for clamping a cable relative to the body when the cable is passed through the body; and a clamp actuator assembly engaging the engagement surface of the body to actuate the strain relief clamp and including a clamp actuator element and a non-rotating element floating with respect to the clamp actuator element and engaging the strain relief clamp such that as the clamp actuator element engages the body, the non-rotating element engages the strain relief clamp so that the clamp clamps the cable more tightly.

6. The cable clamp of claim 5 wherein the body includes external threads and the clamp actuator element includes internal threads for threading onto the outside of the body, and wherein the clamp actuator element includes a skirt extending over a portion of the body when the clamp actuator element is first threaded onto the body.

7. The cable clamp of claim 6 wherein the clamp actuator assembly further includes a ramp and the body includes at least one slot for axially guiding the ramp relative to the body and wherein the skirt on the clamp actuator element covers the at least one slot whenever the clamp actuator element is threaded on the body.

8. The cable clamp of claim 5 wherein the clamp actuator assembly further includes at least one clamping ramp for clamping the strain relief clamp against the cable and wherein the at least one clamping ramp is contained internal to the clamp actuator element.

9. The cable clamp of claim 5 comprising means between the clamp actuator element and the body for self-locking the clamp actuator element relative to the body.

10. The cable clamp of claim 5 wherein the strain relief clamp includes at least one bar for contacting the cable and a ramp on the bar at an approximate center of the bar so that force applied to the bar to clamp the cable is applied to the approximate center of the bar.

11. The cable clamp of claim 5 further including means for axially fixing the strain relief clamp relative to the body so that a clamped cable does not move axially relative to the body.

12. The cable clamp of claim 11 wherein the strain relief clamp includes at least one bar for clamping the cable and wherein the axially fixing means includes rods fixed relative to the body passing through the bar to axially fix the bar.

13. The cable clamp of claim 12 wherein the rods rotationally fix the strain relief clamp to rotationally fix the cable when the cable is clamped.

14. The cable clamp of claim 5 wherein the strain relief clamp further includes at least one ramp and wherein the body includes at least one axial slot, and the clamp actuator element includes a second ramp complimentary to the ramp on the clamp for fitting in and sliding axially with respect to the slot in the body for pushing the strain relief clamp into contact with a cable.

15. The cable clamp of claim 14 wherein the clamp actuator element includes a skirt for covering the threads and the slot on the body whenever the clamp actuator element is threaded on the body.

16. The cable clamp of claim 5 wherein the clamp actuator element includes threads for threading the clamp actuator element on the body wherein the body and clamp actuator threads are formed such that the strain relief clamp can operate over a designated range.

17. The cable clamp of claim 5 wherein the non-rotating element includes a ring floating rotatably with respect to the clamp actuator element.

18. The cable clamp of claim 17 wherein the clamp actuator element includes internal threads for threading on the body and the ring includes radially extending protrusions for engaging the threads on the clamp actuator element.

19. A cable clamp for relieving stress between a cable and a connector with which the cable is associated, the cable clamp comprising:

a body defining a passageway through which a cable may pass and including an engagement surface;

a strain relief clamp internal to the body for clamping a cable relative to the body when the cable is passed through the body;

a clamp actuator assembly having a clamp actuator element engaging the engagement surface of the body to actuate the strain relief clamp and including a non-rotating element floating with respect to the clamp actuator element and engaging the strain relief clamp such that as the clamp actuator element engages the body, the non-rotating element engages the strain relief clamp so that the clamp clamps the cable more tightly;

means between the clamp actuator element and the body for self-locking the clamp actuator element relative to the body; and wherein the self-locking means includes serrations on an interior surface of the clamp actuator element, and a ring separate from the strain relief clamp and having at least one detent thereon for engaging the serrations when the strain relief clamp clamps the cable.

20. A cable clap for relieving stress between a cable and a connector with which the cable is associated, the cable clamp comprising:

a body defining a passageway through which a cable may pass and including an engagement surface;

a strain relief clamp internal to the body for clamping a cable relative to the body when the cable is passed through the body;

a clamp actuator assembly having a clamp actuator element engaging the engagement surface of the body to actuate the strain relief clamp and including a non-rotating element floating with respect to the clamp actuator element and engaging the strain relief clamp such that as the clamp actuator element engages the body, the non-rotating element engages the strain relief clamp so that the clamp clamps the cable more tightly;

wherein the strain relief clamp includes at least one bar for contacting the cable and a ramp on the bar at an approximate center of the bar so that force applied to the bar to clamp the cable is applied to the approximate center of the bar; and wherein the strain relief clamp includes two oppositely facing saddle bars each with a respective ramp on approximate centers of the saddle bars for applying force to the approximate middles of the saddle bars to clamp the cable between the saddle bars.

21. A screwless, self-locking strain relief clamp for a cable, the clamp being adaptable for attachment to a multiple pin end connector assembly, the clamp comprising:

a cylindrical body including means for attaching said body to a connector assembly;

a cylindrical clamp nut including a sleeve for receiving said body and a narrowed end portion for allowing cable entry;

means for securing the body and the sleeve of the cylindrical clamp nut together, said sleeve partially enclosing said body;

releasable locking means in the body including at least one movable cable gripping element disposed around a portion of said cable and wherein the cable gripping element is releasably captivated within said body, said gripping element having a central portion and an end portion;

elongated axial locking elements joined by a ring portion releasably anchored within said sleeve of said clamp nut, said locking elements adapted for frictional movement onto said central portions of said cable gripping elements, said gripping element being thereby centrally pressed to clamp said cable; and self-locking means including a plurality of securing elements on said ring portion of the elongated axial locking elements adapted for mating engagement with a plurality of receiving elements on the narrowed end portion of the clamp nut, for preventing loosening of said clamp about said cable under vibration.

22. A cable clamp for relieving stress between a cable and a connector to which the cable is attached, said cable clamp comprising:

a non-rotatable clamp for clamping the cable, said clamp including a pair of separable and opposing surfaces through which the cable passes, at least one of which includes a receiving wedge for receiving clamping force;

a body attached to said clamp and adapted to attach to the connector for housing said clamp and for preventing relative movement between said clamp and the connector after the cable is clamped by said clamp; and a separate actuator, including a transmitting wedge slidably engaging said receiving wedge, for causing said opposing surface of said at least one clamp having the receiving wedge to move in controllable amounts so as to clamp the cable with controlled force.

23. The cable clamp of claim 22 wherein said opposing surfaces are saddle bars in a truncated arc configuration.

24. The cable clamp of claim 22 wherein each of said opposing surfaces includes a receiving wedge for receiving clamping force, each of said receiving wedges being opposingly oriented with respect to one another.

25. The cable clamp of claim 22 wherein said body means substantially fully encloses said clamp means.

26. The cable clamp of claim 22 wherein said body means has a recess for containing said clamp.

27. The cable clamp of claim 22 wherein said actuator includes an actuation cylindrical portion, said body means includes a body cylindrical portion, and wherein each of said cylindrical portions are threaded for mating engagement with one another.

28. The cable clamp of claim 22 further including a connector disposed within said body means.

29. The cable clamp of claim 28 further including a cable held by said clamp means and electrically connected to said connector.

30. A cable clamp for relieving stress between a cable and a connector to which the cable is attached, said cable clamp comprising:

a clamp for clamping the cable, said clamp including a pair of separable and opposing surfaces through which the cable passes, at least one of which includes a receiving wedge for receiving clamping force;

a body attached to said clamp and adapted to attach to the connector for housing said clamp and for preventing relative movement between said clamp and the connector after the cable is clamped by said clamp;

an actuator, including a transmitting wedge slidably engaging said receiving wedge, for causing said opposing surfaces of said clamp to move toward one another in controllable amounts so as to clamp the cable with controlled force;

wherein each of said opposing surfaces includes a receiving wedge for receiving clamping force, each of said receiving wedges being opposingly oriented with respect to one another; and wherein each of said receiving wedges protrudes from the approximate center of its respective opposing surface.

31. A cable clamp for relieving stress between a cable and a connector to which the cable is attached, said cable clamp comprising:

a clamp for clamping the cable, said clamp including a pair of separable and opposing surfaces through which the cable passes, at least one of which includes a receiving wedge for receiving clamping force;

a body attached to said clamp and adapted to attach to the connector for housing said clamp and for preventing relative movement between said clamp and the connector after the cable is clamped by said clamp;

an actuator, including a transmitting wedge slidably engaging said receiving wedge, for causing said opposing surfaces of said clamp to move toward one another in controllable amounts so as to clamp the cable with controlled force;

further including attachment means for attaching said opposing surfaces to said body means such that said opposing surfaces:

can separate with respect to one another;

can not rotate with respect to said body means, thereby preventing rotation of the cable with respect to said body means after the cable is clamped by said clamp means; and will not fall out of said body means after attachment to said body means.

32. The cable clamp of claim 31 wherein said attachment means includes a pair of roll pins affixed to said body means and channels in said opposing surfaces through which said roll pins slidably pass.

33. The cable clamp of claim 32 wherein each of said roll pins is frictionally engaged in a pair of opposing pinholes in said body means.

34. A cable clamp for relieving stress between a cable and a connector to which the cable is attached, said cable clamp comprising:

a clamp for clamping the cable, said clamp including a pair of separable and opposing surfaces through which the cable passes, at least one of which includes a receiving wedge for receiving clamping force;

a body attached to said clamp and adapted to attach to the connector for housing said clamp and for preventing relative movement between said clamp and the connector after the cable is clamped by said clamp;

an actuator, including a transmitting wedge slidably engaging said receiving wedge, for causing said opposing surfaces of said clamp to move toward one another in controllable amounts so as to clamp the cable with controlled force;

wherein said actuator includes an actuation cylindrical portion, said body means includes a body cylindrical portion, and wherein each of said cylindrical portions are threaded for mating engagement with one another; and wherein said body cylindrical portion has a slot for receiving the transmitting wedge of said actuator.

35. A cable clamp for relieving stress between a cable and a connector to which the cable is attached, said cable clamp comprising:

a clamp for clamping the cable, said clamp including a pair of separable and opposing surfaces through which the cable passes, at least one of which includes a receiving wedge for receiving clamping force;

a body attached to said clamp and adapted to attach to the connector for housing said clamp and for preventing relative movement between said clamp and the connector after the cable is clamped by said clamp;

an actuator, including a transmitting wedge slidably engaging said receiving wedge, for causing said opposing surfaces of said clamp to move toward one another in controllable amounts so as to clamp the cable with controlled force; and wherein said actuator further includes an annular ring and wherein said transmitting wedge is affixed to said annular ring and protrudes from it at an angle substantially perpendicular to the surface of the annular ring.

36. The cable clamp of claim 35 wherein said actuation cylindrical portion has two ends, wherein one of said ends is threaded for mating engagement with said body cylindrical portion, wherein said other end includes an annular lip through which the cable passes, and wherein said transmitting wedge is pressed towards said receiving wedge by pressure asserted by said annular lip against said annular ring and, in turn, to said transmitting wedge.

37. The cable clamp of claim 36 wherein said actuation cylindrical portion and said annular ring have cooperating anti-fallout means for insuring that said annular ring does not fall out of said actuation cylindrical portion when said actuator is detached from said body means.

38. The cable clamp of claim 37 wherein said cooperating anti-fallout means includes threads on the inner wall of said actuation cylinder and a mating protruding surface on the outer perimeter of said annular ring.

39. A cable clamp for relieving stress between a cable and a connector to which the cable is attached, said cable clamp comprising:

a clamp element with a cable contact surface for clamping the cable;

a body attached to said clamp element and adapted to be attached to the connector for housing said clamp element and for preventing relative movement between said clamp element and the connector after the cable is clamped by said clamp element and wherein the body encloses the clamp element;

actuation means in contact with said clamp element for causing said clamp element to clamp the cable with a degree of force which is controlled by the rotation of part of said actuation means, wherein said actuation means includes a cylindrical body which is engaged at one end with said body means and which has a circular lip at the other end, an annular ring disposed in said cylindrical body which abuts said circular lip, and movement translation means coupled to said annular ring and extending between said annular ring and said clamp element for translating rotational movement of said cylindrical body into a force exerted by said annular ring on said clamp element; and a detent mechanism on said actuation means which inhibits rotation of said cylindrical body, wherein said detent mechanism includes a protrusion on said annular ring and a plurality of serrations in said circular lip positioned to matingly engage said protrusion as said cylindrical body is rotated.

40. The cable clamp of claim 39 wherein said serrations are elongated along respective axes, equally spaced in a circular pattern, and positioned such that each of their elongated axes lie on a radius of said circular pattern.

41. The cable clamp of claim 40 wherein said detent mechanism includes a plurality of protrusions equally spaced on said annular ring.

42. A cable clamp for relieving stress between a cable and a connector to which the cable is attached, said cable clamp comprising:

clamp means for clamping the cable, said clamp means including a pair of separable and opposing surfaces through which the cable passes, at least one of which includes a receiving wedge for receiving clamping force;

body means attached to said clamp means, and adapted to attach to a connector, for housing said clamp means and for preventing relative movement between said clamp means and a connector after the cable is clamped by said clamp means;

rotatable actuation means, including a transmitting wedge slidably engaging said receiving wedge, for causing said opposing surfaces of said clamp means to move toward one another with a degree of force which is controlled by the rotation of said actuation means so as to clamp the cable with controlled force; and self-locking means engaging said actuation means for reducing the tendency of said actuation means to rotate after the cable has been firmly clamped by said clamp means, said self-locking means including a detent mechanism engaging said actuation means which inhibits rotation of said actuation means when the force applied to the cable by said clamp means reaches a threshold amount.

43. A cable clamp for relieving stress between a cable and a connector to which the cable is attached, said cable clamp comprising:

a clamp for clamping the cable, said clamp including a pair of separable and opposing surfaces through which the cable passes, at least one of which includes a receiving wedge for receiving clamping force;

a body attached to said clamp and adapted to attach to the connector for housing said clamp and for preventing relative movement between said clamp and the connector after the cable is clamped by said clamp;

an actuator, including a transmitting wedge slidably engaging said receiving wedge, for causing said opposing surfaces of said clamp to move toward one another in controllable amounts so as to clamp the cable with controlled force;

wherein said opposing surfaces are saddle bars in a truncated arc configuration; and wherein said receiving wedge protrudes from the approximate center of one of said opposing surfaces.

* * * * *